US006843677B2

(12) United States Patent
Fukuda

(10) Patent No.: US 6,843,677 B2
(45) Date of Patent: Jan. 18, 2005

(54) CONNECTOR AND CONNECTOR HOUSING

(75) Inventor: Eiji Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/218,507

(22) Filed: Aug. 15, 2002

(65) Prior Publication Data

US 2003/0036302 A1 Feb. 20, 2003

(30) Foreign Application Priority Data

Aug. 17, 2001 (JP) ..... 2001-248224
Aug. 8, 2002 (JP) ..... 2002-231249

(51) Int. Cl.[7] ..... H01R 13/64
(52) U.S. Cl. ..... 439/374; 439/385
(58) Field of Search ..... 439/374, 378, 439/350, 354, 357–8, 358, 206, 608, 752, 594, 732, 385, 345, 650

(56) References Cited

U.S. PATENT DOCUMENTS 3,137,535 A * 6/1964 Collier et al. ..... 439/350
4,054,346 A 10/1977 Schultz ..... 339/75 T
4,333,699 A * 6/1982 Brorein ..... 439/592
4,449,776 A * 5/1984 Carmo et al. ..... 439/350
5,181,865 A 1/1993 Hayes, Sr. ..... 439/752
5,613,881 A * 3/1997 Ichida et al. ..... 439/680
6,050,838 A * 4/2000 Norizuki et al. ..... 439/310
6,086,419 A * 7/2000 Marpoe, Jr. ..... 439/595
6,179,643 B1 * 1/2001 Fukuda ..... 439/358
6,206,717 B1 * 3/2001 Matsumoto ..... 439/354
6,332,800 B2 * 12/2001 Kodama ..... 439/357
6,375,500 B1 * 4/2002 Murakami et al. ..... 439/587

FOREIGN PATENT DOCUMENTS

| | | |
|---|---|---|
| JP | 9-306592 | 11/1997 |
| JP | 2001-283966 | 10/2001 |
| JP | 2001-307819 | 11/2001 |
| JP | 2002-200947 | 7/2002 |
| WO | 93/00726 | 1/1993 |

* cited by examiner

*Primary Examiner*—Ross Gushi
*Assistant Examiner*—X. Chung-Trans
(74) *Attorney, Agent, or Firm*—Armstrong, Kratz, Quintos, Hanson & Brooks, LLP

(57) ABSTRACT

A connector is provided, by which terminal fittings can be securely electrically connected to each other and a connector housing is provided, by which a terminal fittings in a mating connector housing can be securely electrically connected to a terminal fittings received in the connector housing. A connector having a lock security mechanism includes a female housing and male housing. The female housing includes a body part for receiving a male terminal and a tube-shaped bushing. A first rib protruding from the outer surface of the bushing is provided. The male housing includes a body part for receiving a female terminal and a tube-shaped bushing. A second rib protruding from the inner surface of the bushing is provided. When the female housing is coupled with the male housing, the first rib comes in contact with the second rib.

11 Claims, 14 Drawing Sheets

CONNECTOR AND CONNECTOR HOUSING

BACKGROUND OF THE INVENTION (1) Field of the Invention

The present invention relates to a connector and connector housing used for connecting electric wires and so on.

(2) Description of the Related Art

A wiring harness for use in a motor vehicle as a mobile unit includes a connector, in which a male connector housing (hereinafter, male housing) and a female connector housing (hereinafter, female housing) are connected to each other. The male and female housings receive terminal fittings with an electric wire.

The female housing is made of synthetic resin. The female housing formed in a tube-shape receives a male-type terminal fittings (hereinafter, male terminal) inside. The male housing is made of synthetic resin. The male housing includes a tube-shaped bushing and a body part disposed in the bushing. A peripheral wall of the bushing is gradually formed thin as approaching an opening of the male housing.

The body part receives, for example, a female-type terminal fittings (hereinafter, female terminal) inside. The body part of the male housing enters into the female housing through an opening of the female housing and the female housing enters into the bushing of the male housing through an opening of the bushing, thereby the two connector housings are coupled with each other and then, the male and female terminals are electrically connected to each other.

Both of the female and male housings are molded from synthetic resin and the like. Upon the molding, various molding methods including injection molding can be used. When the molded product is taken out from the mold after the molding, the female and male housings possibly might have been deformed, especially in the direction, in which the opening thereof extends.

If being deformed in the direction, in which the opening extends, there has been possibly formed a gap between the two connector housings when being coupled with each other. In such a case, both of the male and female terminals easily vibrate relatively to each other, thereby the electric connection between the two terminals might have possibly become unstable.

SUMMARY OF THE INVENTION

Therefore, the first objective of the present invention is to provide a connector, by which the terminal fittings to be received in connector housings of the connector can be securely electrically connected to each other. The second objective of the present invention is to provide a connector housing, by which a terminal fittings in a mating connector housing can be securely electrically connected to a terminal fittings received in the connector housing.

In order to attain the first objective, the present invention is to provide a connector comprising:

a tube-shaped first connector housing having a first opening situated at one end of the first connector housing;

a tube-shaped second connector housing having a second opening situated at one end of the second connector housing, into which the first connector housing is inserted as the first opening facing the second opening so that the first and second connector housings are coupled to construct the connector; and a first rib protruding from an outer surface of the first connector housing, wherein when the first and second connector housings are coupled, the first rib comes in contact with an inner surface of the second connector housing.

In the connector described above, the connector includes the first rib protruding from the outer surface of the first connector housing. When the first and second connector housings are coupled with each other, the first rib comes in contact with the inner surface of the second connector housing. Therefore, even if the first connector housing is deformed in the direction, in which the first opening extends, backlash (looseness) hardly arises between the first and second connector housings after the two connector housings are coupled with each other.

Therefore, the backlash hardly arises between the first and second connector housings, thereby the terminal fittings received in these housings can be securely electrically connected to each other.

In order to attain the first objective, the present invention is to provide a connector comprising:

a tube-shaped first connector housing having a first opening situated at one end of the first connector housing;

a tube-shaped second connector housing having a second opening situated at one end of the second connector housing, into which the first connector housing is inserted as the first opening facing the second opening so that the first and second connector housings are coupled to construct the connector; and a second rib protruding from an inner surface of the second connector housing, wherein when the first and second connector housings are coupled, the second rib comes in contact with an outer surface of the first connector housing.

In the connector described above, the connector includes the second rib protruding from the inner surface of the second connector housing. When the first and second connector housings are coupled with each other, the second rib comes in contact with the outer surface of the first connector housing. Therefore, even if the second connector housing is deformed in the direction, in which the second opening extends, backlash hardly arises between the first and second connector housings after the two connector housings are coupled with each other.

Therefore, the backlash hardly arises between the first and second connector housings, thereby the terminal fittings received in these housings can be securely electrically connected to each other.

In order to attain the first objective, the present invention is to provide a connector comprising:

a tube-shaped first connector housing having a first opening situated at one end of the first connector housing;

a tube-shaped second connector housing having a second opening situated at one end of the second connector housing, into which the first connector housing is inserted as the first opening facing the second opening so that the first and second connector housings are coupled to construct the connector;

a first rib protruding from an outer surface of the first connector housing; and a second rib protruding from an inner surface of the second connector housing, wherein when the first and second connector housings are coupled, the first and second ribs come in contact with each other.

In the connector described above, the connector includes the first rib protruding from the outer surface of the first connector housing and the second rib protruding from the inner surface of the second connector housing. When the first and second connector housings are coupled with each other, the first and second ribs come in contact with each other. Therefore, even if the first and second connector housings are deformed in each direction, in which the first and second openings extend, respectively, backlash hardly arises between the first and second connector housings after the two connector housings are coupled with each other.

Therefore, the backlash hardly arises between the first and second connector housings, thereby the terminal fittings received in these housings can be securely electrically connected to each other.

Preferably, the protrusion length of the first rib from the outer surface gradually increases as the first rib leaves the first opening.

With the construction described above, the protrusion length of the first rib from the outer surface gradually increases as the first rib leaves the first opening. Therefore, even if the first connector housing is deformed in the direction, in which the first opening extends, the surface of the first rib becomes parallel to the insertion direction, in which the first connector housing is inserted into the second connector housing. Therefore, when the first and second connector housings are coupled with each other, the surface of the first rib closely comes in contact with the inner surface of the second connector housing or the second rib.

Therefore, even if the first connector housing is deformed in the direction, in which the first opening extends, backlash hardly arises between the first and second connector housings after the two connector housings are coupled with each other.

Therefore, the backlash hardly arises between the first and second connector housings, thereby the terminal fittings received in these housings can be securely electrically connected to each other.

Preferably, the protrusion length of the second rib from the inner surface gradually decreases as the second rib leaves the second opening.

With the construction described above, the protrusion length of the second rib from the inner surface gradually decreases as the second rib leaves the second opening. Therefore, even if the second connector housing is deformed in the direction, in which the second opening extends, the surface of the second rib becomes parallel to the insertion direction, in which the first connector housing is inserted into the second connector housing. Therefore, when the first and second connector housings are coupled with each other, the surface of the second rib closely comes in contact with the outer surface of the first connector housing.

Therefore, even if the second connector housing is deformed in the direction, in which the second opening extends, backlash hardly arises between the first and second connector housings after the two connector housings are coupled with each other.

Therefore, the backlash hardly arises between the first and second connector housings, thereby the terminal fittings received in these housings can be securely electrically connected to each other.

Preferably, an opposite end of the second connector housing is closed by a wall, the second rib protrudes from the inner surface in a range from the second opening to the wall, and an end of the second rib is provided with a hole penetrating through the wall.

With the construction described above, the hole is provided at the end of the second rib. The hole penetrates through the wall which closes the opposite end of the second connector housing. Therefore, a part for molding the second rib of a mold to mold the second connector housing can be slid through the hole.

Therefore, the terminal fittings received in the first and second connector housings can be securely electrically connected to each other, and the second connector housing can be easily molded.

In order to attain the second objective, the present invention is to provide a connector housing comprising:

a first casing formed in a tube-shape;

a first opening situated at one end of the first casing; and a first rib protruding from an outer surface of the first casing, wherein the connector housing is inserted into a first mating connector housing from the first opening so as to be coupled with the first mating connector housing, and when the connector housing is coupled with the first mating connector housing, the first rib comes in contact with an inner surface of the first mating connector housing.

In the connector housing described above, the connector housing includes a first rib protruding from the outer surface of the first casing. When the connector housing is coupled with the first mating connector housing, the first rib comes in contact with the inner surface of the first mating connector housing. Therefore, even if the connector housing is deformed in the direction, in which the first opening extends, backlash hardly arises between the connector housing and the first mating connector housing after the two housings are coupled with each other.

Therefore, the backlash hardly arises between the connector housing and the first mating connector housing, and the terminal fittings received in the connector housing can be securely electrically connected to the terminal fittings received in the first mating connector housing.

Preferably, the protrusion length of the first rib from the outer surface gradually increases as the first rib leaves the first opening.

With the construction described above, the protrusion length of the first rib from the outer surface gradually increases as the first rib leaves the first opening. Therefore, even if the connector housing is deformed in the direction, in which the first opening extends, the surface of the first rib becomes parallel to the insertion direction, in which the connector housing is inserted into the first mating connector housing. Therefore, when the connector housing is coupled with the first mating connector housing, the surface of the first rib closely comes in contact with the inner surface of the first mating connector housing.

Therefore, even if the connector housing is deformed in the direction, in which the first opening extends, backlash hardly arises between the connector housing and the first mating connector housing after the two connector housings are coupled with each other.

Therefore, the backlash hardly arises between the connector housing and the first mating connector housing, and the terminal fittings received in the connector housing can be securely electrically connected to the terminal fittings received in the first mating connector housing.

In order to attain the second objective, the present invention is to provide a connector housing comprising:

a second casing formed in a tube-shape;

a second opening situated at one end of the second casing; and a second rib protruding from an inner surface of the second casing, wherein the connector housing receives a second mating connector housing inside from the second opening so as to couple with the second mating connector housing, and when the connector housing is coupled with the second mating connector housing, the second rib comes in contact with an outer surface of the second mating connector housing.

In the connector housing described above, the connector housing includes a second rib protruding from the inner surface of the second casing. When the connector housing is coupled with the second mating connector housing, the second rib comes in contact with the outer surface of the second mating connector housing. Therefore, even if the connector housing is deformed in the direction, in which the second opening extends, backlash hardly arises between the connector housing and the second mating connector housing after the two housings are coupled with each other.

Therefore, the backlash hardly arises between the connector housing and the second mating connector housing, and the terminal fittings received in the connector housing can be securely electrically connected to the terminal fittings received in the second mating connector housing.

Preferably, the protrusion length of the second rib from the inner surface gradually decreases as the second rib leaves the second opening.

With the construction described above, the protrusion length of the second rib from the inner surface gradually decreases as the second rib leaves the second opening. Therefore, even if the connector housing is deformed in the direction, in which the second opening extends, the surface of the second rib becomes parallel to the insertion direction, in which the second mating connector housing is inserted into the connector housing. Therefore, when the connector housing is coupled with the second mating connector housing, the surface of the second rib closely comes in contact with the outer surface of the second mating connector housing. Therefore, even if the connector housing is deformed in the direction, in which the second opening extends, backlash hardly arises between the connector housing and the second mating connector housing after the two connector housings are coupled with each other.

Therefore, the backlash hardly arises between the connector housing and the second mating connector housing, and the terminal fittings received in the connector housing can be securely electrically connected to the terminal fittings received in the second mating connector housing.

Preferably, an opposite end of the second casing is closed by a wall, the second rib protrudes from the inner surface in a range from the second opening to the wall, and an end of the second rib is provided with a hole penetrating through the wall.

With the construction described above, the hole is provided at the end of the second rib. Therefore, a part of a mold for molding the second rib can be slid through the hole.

Therefore, the terminal fittings received in the connector housing can be securely electrically connected to the terminal fittings received in the second mating connector housing, and the connector housing can be easily molded.

DESCRIPTION OF THE PREFERRED EMBODIMENTS

Figure 1:
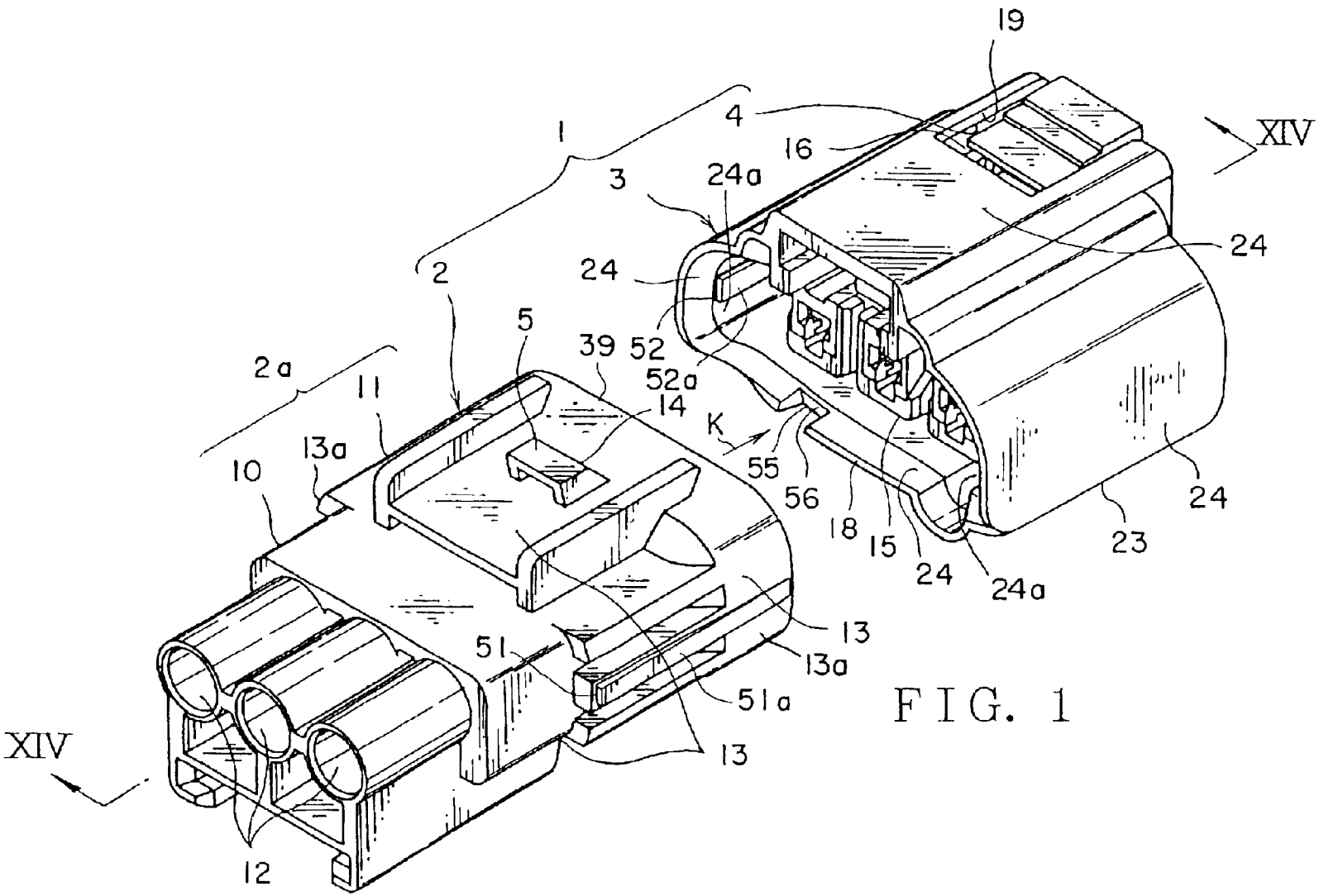
FIG. 1 is an exploded perspective view illustrating a connector having a lock security mechanism according to a preferred embodiment of the present invention.
Figure 2:
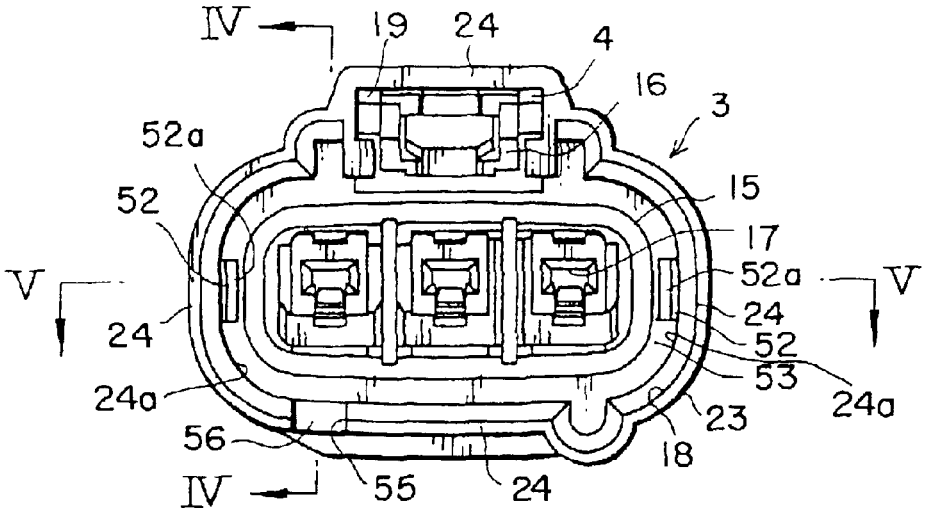
FIG. 2 is a front view of a male housing of the connector having a lock security mechanism shown in FIG. 1.
Figure 3:
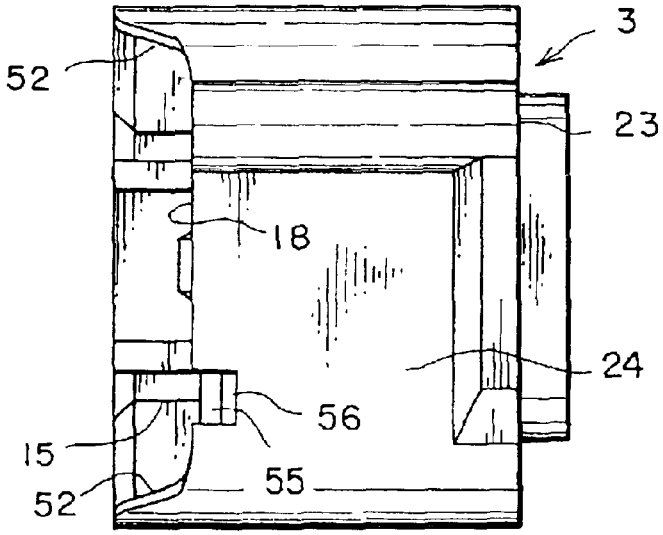
FIG. 3 is a bottom view of the male housing shown in FIG. 2.
Figure 13:
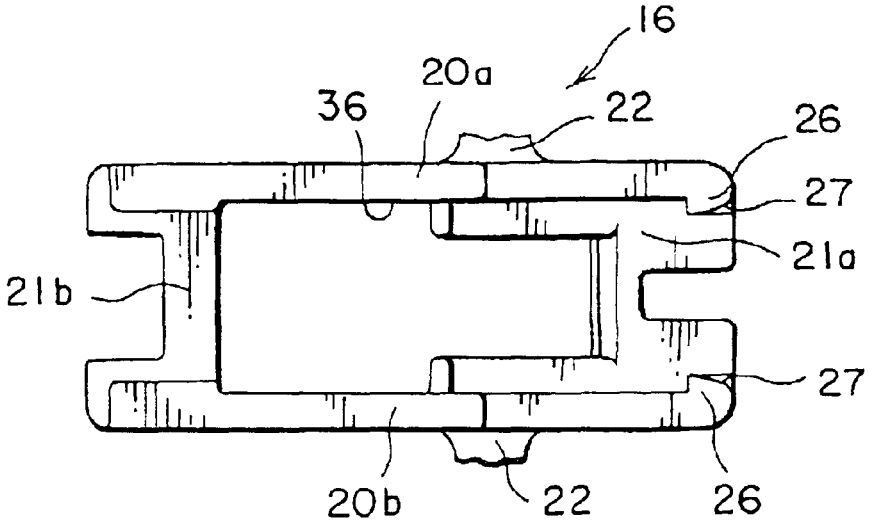
FIG. 13 is a bottom view illustrating a locking arm of the connector having a lock security mechanism shown in FIG. 1.
Figure 14:
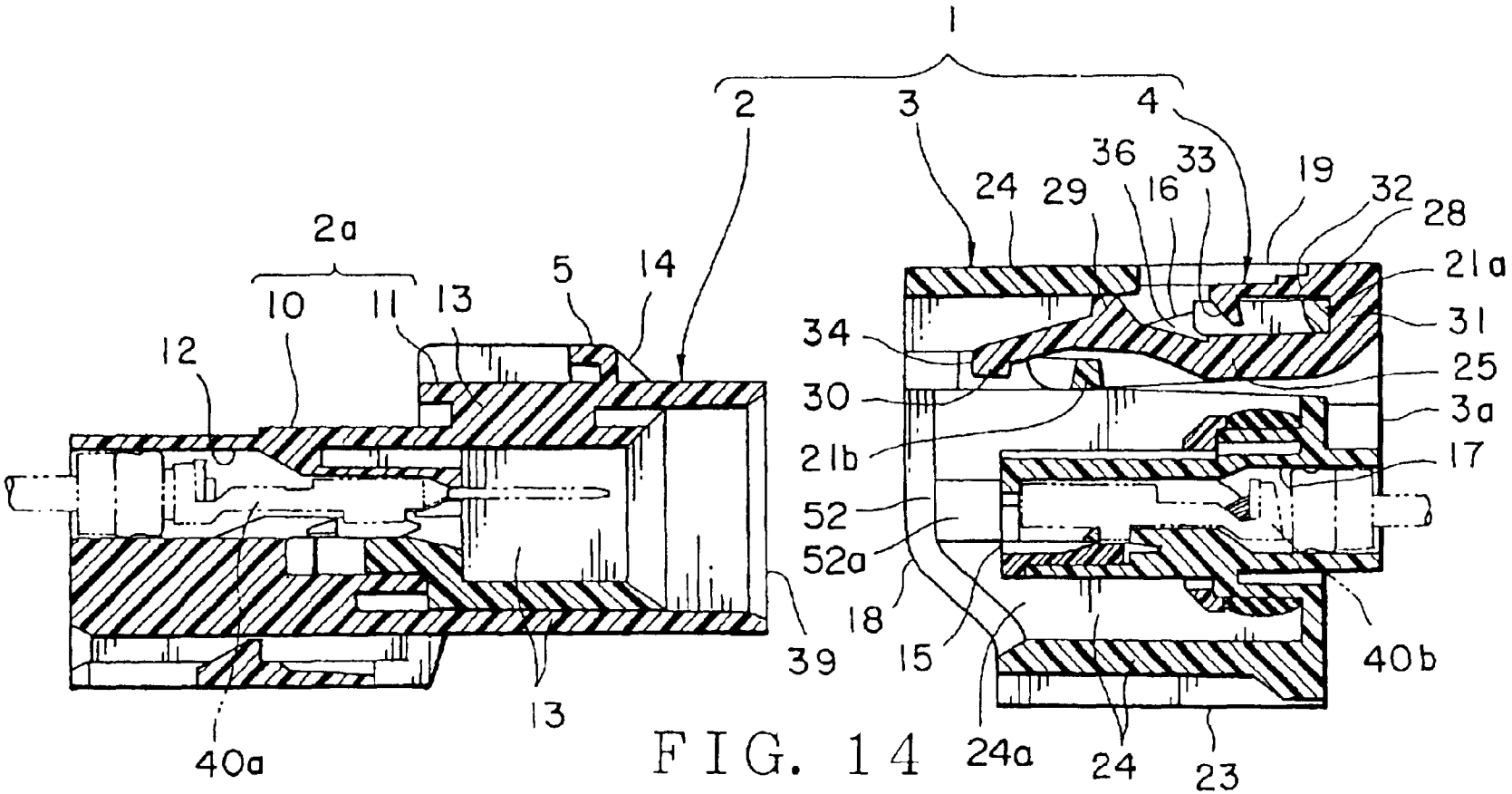
FIG. 14 is a cross sectional view taken along XIV—XIV line in FIG. 1.
Figure 18:
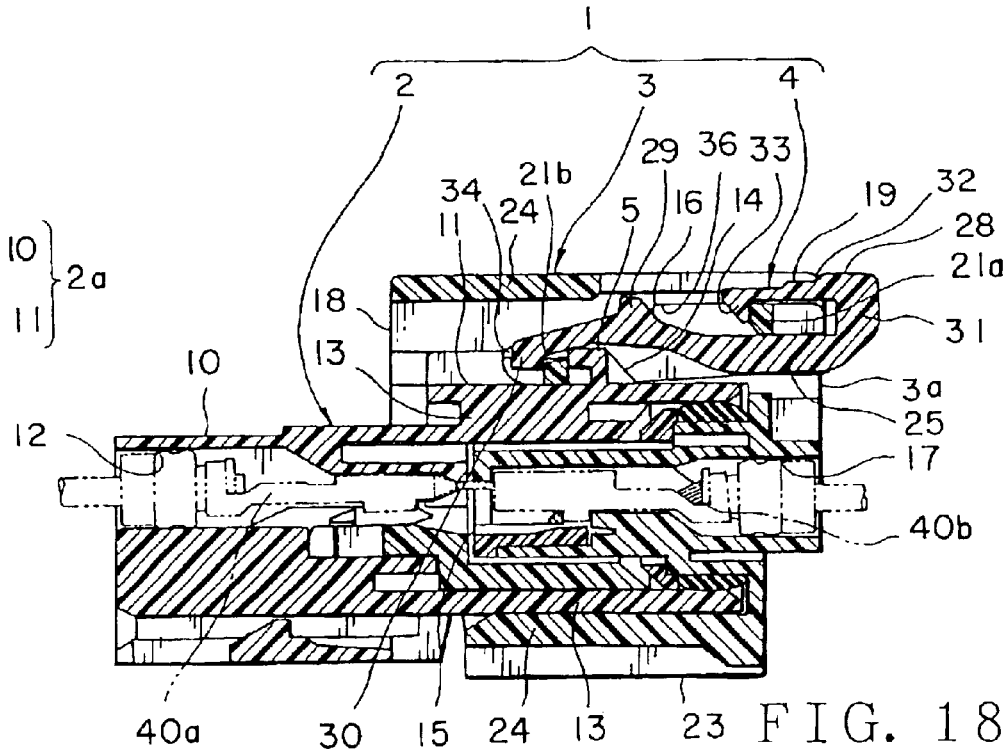
FIG. 18 is a cross sectional view illustrating a state, in which a locking projection engages with a locking hole of the locking arm starting from the state shown in FIG. 17.
Figure 19:
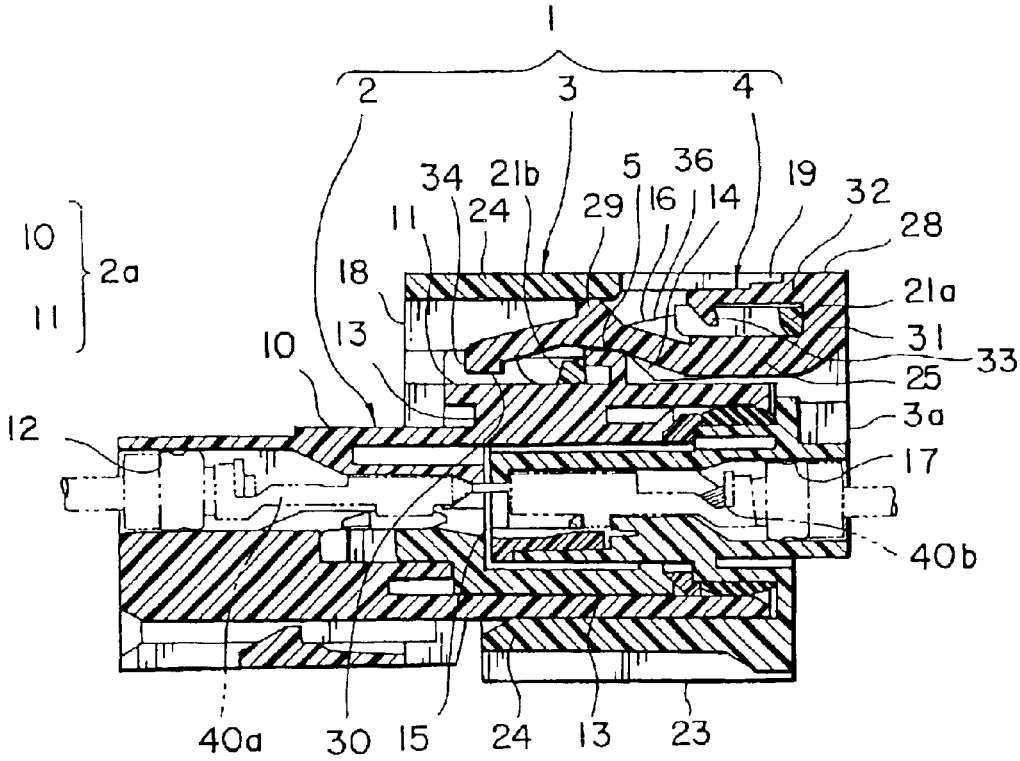
FIG. 19 is a cross sectional view illustrating a state, in which the lock security member is displaced from the state shown in FIG. 18 to a regulated position.

A connector having a lock security mechanism as a connector according to a preferred embodiment of the present invention will be explained with reference to FIGS. 1–23. The connector 1 having a lock security mechanism shown in FIG. 1 and the other figures constitutes a wiring harness arranged in a motor vehicle and so on. As shown in FIGS. 1, 14 and 19, the connector 1 having a lock security mechanism includes a female-type connector housing (hereinafter, female housing) 2, a male-type connector housing (hereinafter, male housing) 3, and a lock security member 4.

The female housing 2 is made of synthetic resin. As shown in FIGS. 1, 6–10, 14–19, the female housing 2 includes a housing body 2*a*. The housing body 2*a* includes a body part 10 and tube-shaped bushing 11. In this specification, a connector housing formed in a tube-shape, into which a body part 15 of the male housing 3 is inserted, is called a female-type connector housing.

As shown in FIG. 14, the body part 10 of the housing body 2*a* receives a plurality of male-type terminal fittings (hereinafter, male terminal) 40*a*. The body part 10 includes a plurality of terminal-receiving chambers 12 arranged in parallel to each other. Each terminal-receiving chamber 12 extends straightly and receives the male terminal 40*a*.

The bushing 11 receives the body part 15 (explained later on) of the male housing 3 therein. The bushing 11 is formed in a box-shape (tube-shape) including a plurality of peripheral walls 13 each of which continues to the outer edge of the body part 10. That is, the bushing 11 continues to the body part 10. An end (an end of the bushing 11) of the peripheral wall 13, which stays away from the body part 10, forms an opening 39 for receiving the body part 15 of the male housing 3. As described above, the bushing 11 is formed in a tube-shape. Therefore, the female housing 2 is formed in a tube-shape.

A locking projection 5 as a locking member is formed on a peripheral wall 13 situated at upper side of the bushing 11 in the figure. The locking projection 5 protrudes from an outer surface of the peripheral wall 13. The locking projection 5 is formed at the center of the peripheral wall 13 in the width direction thereof and in the direction, in which the body part 10 and bushing 11 continue to each other.

The locking projection 5 is provided with a tapered surface 14 at the end thereof near to the opening 39. The tapered surface 14 is inclined relatively to both of the direction of the outer surface of the peripheral wall 13 and the direction crossing at right angles, and also is inclined in the direction of gradually leaving, the opening 39 as leaving the peripheral wall 13. The locking projection 5 engages with a locking hole 36 of a locking arm 16 (explained later on).

Figure 10:
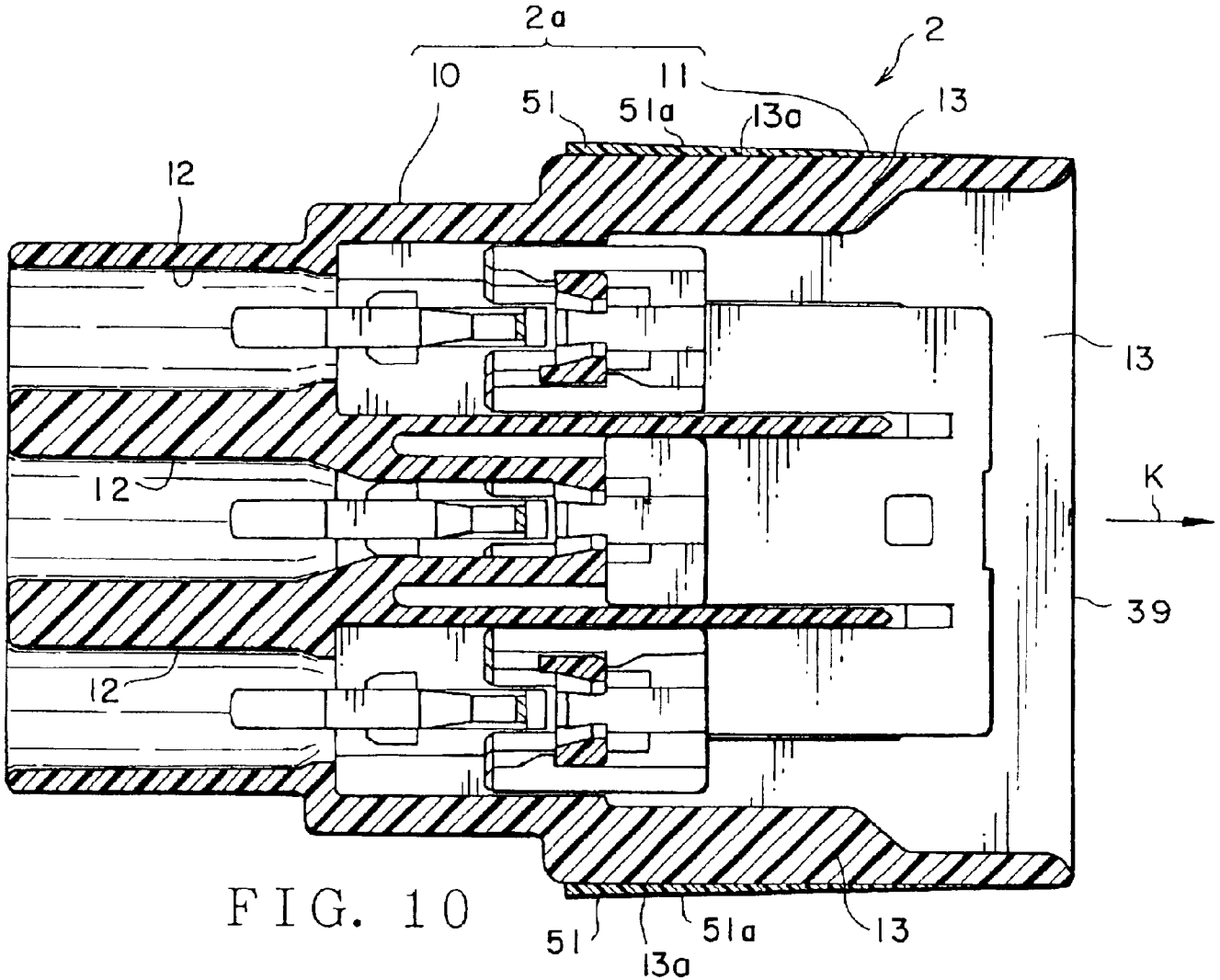
FIG. 10 is a cross sectional view taken along X—X line in FIG. 8.

As shown in FIG. 10, each first rib 51 is formed on a pair of the peripheral walls 13 having a distance therebetween along the width direction of the bushing 11, on which the lock projection 5 is not formed. The first rib 51 protrudes toward the outside of the busing 11 from the outer surface 13*a* of the peripheral wall 13. The outer surface 13*a* is the outer surface of the connector housing (female housing 2). The outer surface of the connector housing (female housing 2) or bushing 11 is the outer surface of the connector housing (female housing 2) which faces an inner surface 24*a* (explained later on) of the mating connector housing (male housing 3) when the housings 2 and 3 are coupled with each other. That is, the first rib 51 protrudes from the outer surface 13*a* of the female housing 2. The first rib 51 protrudes from the outer surface 13*a* of the bushing 11.

The first rib 51 extends along the direction K (shown by an arrow in FIG. 10), in which the female housing 2 is inserted into the male housing 3. The protrusion length of the first rib 51 from the peripheral wall 13, that is, from the outer surface 13*a* of the female housing 2 gradually increases as the first rib 51 leaves the opening 39. As is shown in FIG. 10 (and also in FIGS. 1, 5, 7, 22, and 24–26), the height of the rib increases in proportion to the distance, whereby such a rib comprises a ramp. The surface 51*a* of the first rib 51 comes in contact with the second rib 52 when the housings 2 and 3 are coupled with each other. The surface 51 a of the first rib 51 is flat and approximately parallel with the outer surface 13*a* of the peripheral wall 13. That is, the surface 51*a* runs along the outer surface 13*a*. Although the hatching direction of the first rib 51 is reverse to that of the peripheral wall 13 in FIG. 10, the first rib 51 and the peripheral wall 13 are formed integrally with each other.

The male housing 3 is made of synthetic resin. As shown in FIGS. 1–5 and 14–19, the male housing 3 includes a body part 15, bushing 23 and locking arm 16. In this specification, a connector housing, which has the body part 15 to be inserted into the tube-shaped female housing 2 and so on, is called a male-type connector housing.

As shown in FIG. 14, the body part 15 receives a plurality of female-type terminal fittings (hereinafter, female terminal) 40*b*. The body part 15 includes a plurality of terminal-receiving chambers 17 arranged in parallel to each other. Each terminal-receiving chamber 17 extends straightly and receives the female terminal 40*b*. The body part 15 is inserted into the bushing 11 so that the terminal-receiving chamber 17 continues to the terminal-receiving chamber 12 of the female housing 2.

Figure 5:
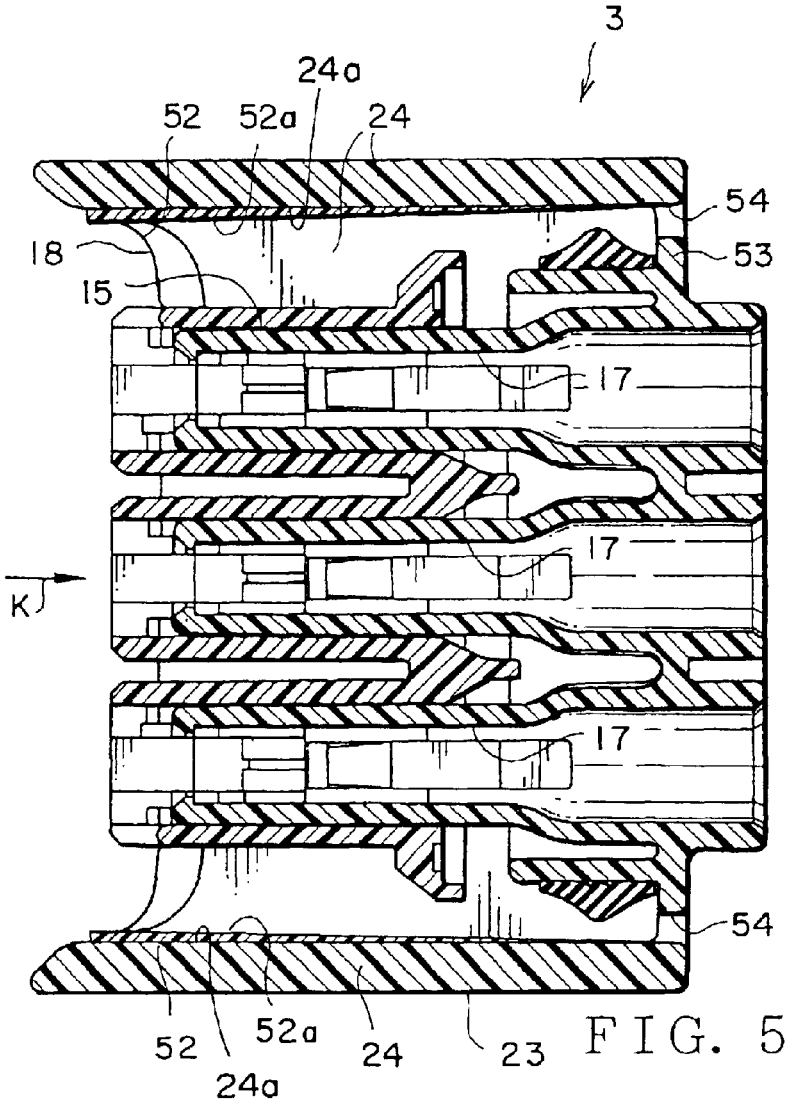
FIG. 5 is a cross sectional view taken along V—V line in FIG. 2.
Figure 6:
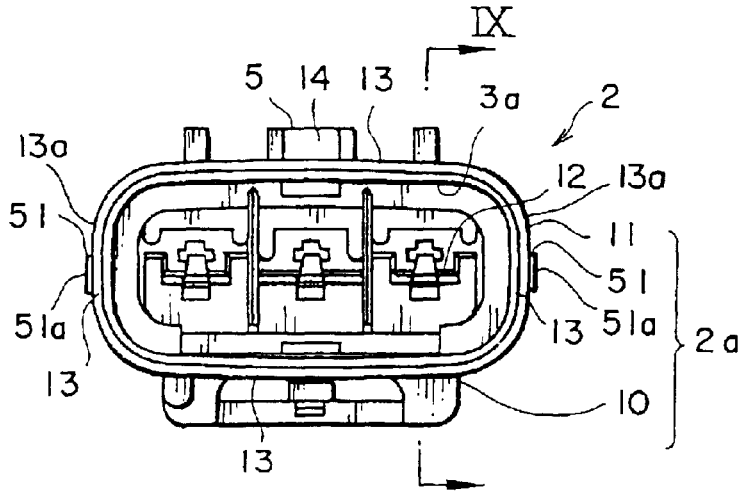
FIG. 6 is a front view of a female housing of the connector having a lock security mechanism shown in FIG. 1.
Figure 7:
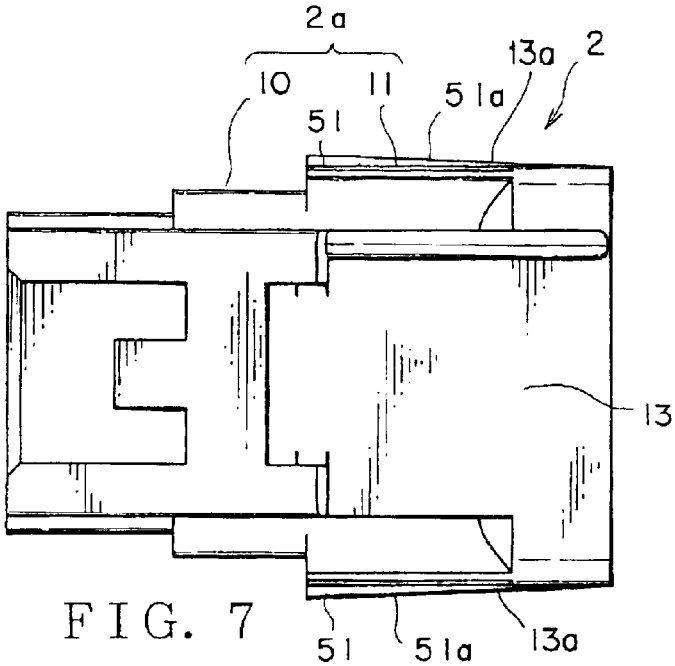
FIG. 7 is a bottom view of the female housing shown in FIG. 6.
Figure 8:
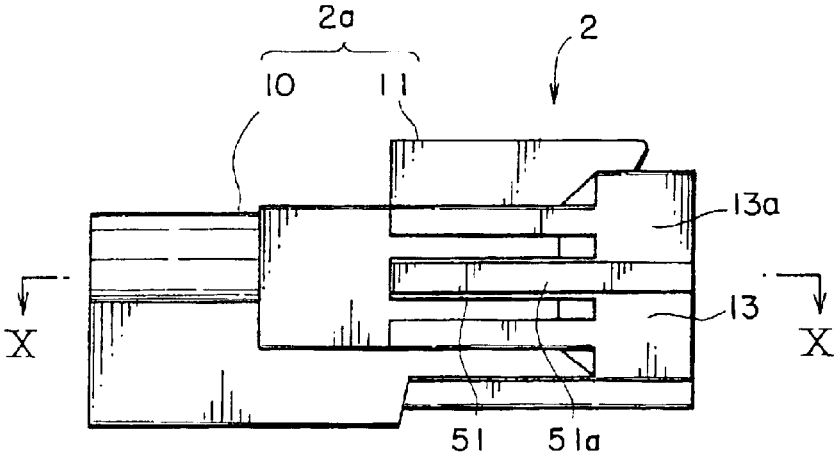
FIG. 8 is a side view of the female housing shown in FIG. 6.
Figure 9:
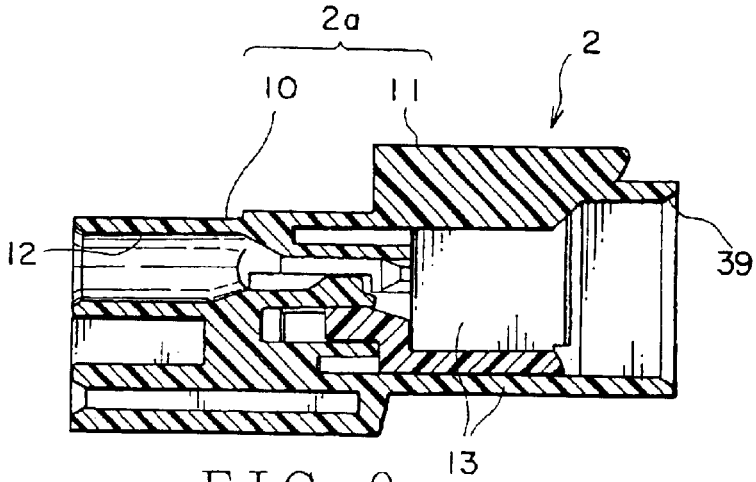
FIG. 9 is a cross sectional view taken along IX—IX line in FIG. 6.

The bushing 23 is formed in a box-shape (tube-shape) including a plurality of peripheral walls 24. That is, the male housing 3 is formed in a tube-shape. The bushing 23 receives the body part 15. As shown in FIG. 5, one end of a plurality of the peripheral walls 24 (that is, one end of the bushing 23) forms an opening 18 for receiving the female housing 2. The opposite end of the peripheral wall 24 (that is, the opposite end of the bushing 23) continues to a wall 53. The wall 53 continues to the opposite end of every peripheral wall 24. The wall 53 closes the opposite end of the bushing 23.

The wall 53 continues to the outer edge of the body part 15. The wall 53 is provided with a pair of holes 54, each of which penetrates through the wall 53. Therefore, the hole 54 communicates the inside of the busing 23 to the outside thereof. The inner edge of the hole 54 has the same plane as that of a surface 52*a* of a second rib 52 explained later on. That is, the hole 54 is opened at the end of the second rib 52. In other words, the hole 54 is provided at the end of the second rib 52. As explained later on, when the female housing 2 is coupled with the male housing 3, each hole 54 communicates the inside of the busing 23 to the outside thereof. The hole 54 is used for draining water, which enters into the busing 23, to the outside of the bushing 23.

The bushing 23 receives the female housing 2. The peripheral wall 24 is gradually formed thin as the peripheral wall 24 approaching the opening 18. A notch 19 is formed on one peripheral wall 24 situated upper side in the figure. The notch 19 is formed by notching the peripheral wall 24 and penetrates through the peripheral wall 24.

A notch 55 as obstruction means is formed on the other peripheral wall 24 situated at the lower in the figure. The notch 55 is formed hollow from the edge of the peripheral wall 24, which constitutes the opening 18. That is, the notch 55 is formed by notching the edge of the bushing 23 near to the second female housing 2.

Figure 4:
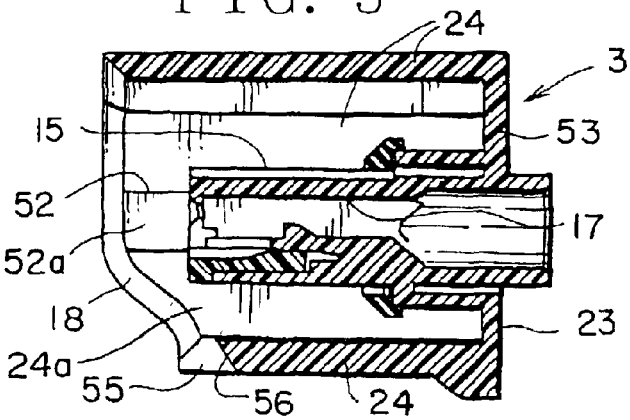
FIG. 4 is a cross sectional view taken along IV—IV line in FIG. 2.

As shown in FIG. 4, a face 56 of the notch 55, which faces the female housing 2, is gradually inclined in the outward direction of the male housing 3 as leaving the opening 18. The face 56 is also inclined relatively to the direction, in which the female housing 2 and male housing 3 approach each other when the female housing 2 is coupled with the male housing 3. That is, the face 56 is inclined relatively to the insertion direction of the second female housing 2 into the bushing 23.

As shown in FIG. 5, each second rib 52 is formed on a pair of the peripheral walls 24 having a distance therebetween along the width direction of the bushing 23, on which the notch 19, 55 is not formed. The second rib 52 protrudes toward the inside of the busing 23 from the inner surface 24*a* of the peripheral wall 24. The inner surface 24*a* is the inner surface of the connector housing (male housing 3). The inner surface of the connector housing (male housing 3) or the bushing 23 is the inner surface of the connector housing (male housing 3) which faces the outer surface 13*a* of the mating connector housing (female housing 2) when the housings 2 and 3 are coupled with each other. That is, the second rib 52 protrudes from the inner surface 24*a* of the male housing 3. The second rib 52 protrudes from the inner surface 24*a* of the bushing 23.

The second rib 52 extends along the direction K (shown by an arrow in FIG. 5), in which the female housing 2 is inserted into the male housing 3. The second rib 52 protrudes from the inner surface 24*a* of the peripheral wall 24 from the opening 18 to the wall 53. The protrusion length of the second rib 52 from the peripheral wall 24, that is, from the inner surface 24*a* of the male housing 3 gradually decreases as the second rib 52 leaves the opening 18. The surface 52*a* of the second rib 52 comes in contact with the first rib 51 when the housings 2 and 3 are coupled with each other. The surface 52*a* of the second rib 52 is flat and approximately parallel with the inner surface 24*a* of the peripheral wall 24. That is, the surface 52*a* runs along the inner surface 24*a*. Although the hatching direction of the second rib 52 is reverse to that of the peripheral wall 24 in FIG. 5, the second rib 52 and the peripheral wall 24 are formed integrally with each other.

The locking arm 16 is made of synthetic resin and can be deformed resiliently. As shown in FIG. 13, the locking arm 16 is formed in a frame-shape including a pair of first bars 20*a*, 20*b* and a pair of second bars 21*a*, 21*b*. The pair of first bars 20*a*, 20*b* is arranged in parallel to each other having a distance therebetween. Each second bar 21*a*, 21*b* is shorter than each first bar 20*a*, 20*b*. The pair of second bars 21*a*, 21*b* is arranged in parallel to each other having a distance therebetween. Each second bar 21*a*, 21*b* connects the corresponding ends of the first bar 20*a*, 20*b*.

The locking arm 16 is arranged inside the bushing 23. The locking arm 16 is disposed between the peripheral wall 24 on which the hole 19 is provided and the body part 15. The length direction of the locking arm 16 is parallel to the length direction of the terminal-receiving chamber 17, that is, the length direction of the female terminal 40*b*. The length direction of the locking arm 16 is parallel to the direction (arrow K shown in FIG. 1) of the housings 2 and 3 approaching each other when they are coupled to each other. At the center in the length direction of the locking arm 16, a pair of support pieces 22 (shown in FIG. 13) is attached.

The support piece 22 continues to both edges of the locking arm 16 in the width direction. The support piece 22 continues to both of the edge of the locking arm 16 in the width direction and the inner surface of the bushing 23. The support piece 22 is integrally formed with both of the locking arm 16 and the bushing 23. The support piece 22 can be resiliently deformed. The locking arm 16 is supported movable relatively to the bushing 23 having the center of the length direction as a center. That is, when the support piece 22 is resiliently deformed, the center of the locking arm 16 in the length direction is hardly displaced relatively to the bushing 23 while both ends of the locking arm 16 in the length direction is displaced relatively to the bushing 23.

As shown in FIG. 13, a claw 26 is provided at each end of the pair of the first bars 20*a*, 20*b*, each said end being situated farther from the opening 18. Each claw 26 protrudes from the end in the direction of approaching each other. An inclined surface 27 is provided at the end of the claw 26, said end being situated farther from the opening 18. The inclined surface 27 is inclined in the inward direction of the locking arm 16 as approaching the opening 18, that is, as approaching the female housing 2, and is inclined relatively to both of the length and width directions of the locking arm 16.

The inside of the locking arm 16 forms a locking hole 36. The locking projection 5 enters inside the locking hole 36, thereby the locking projection 5 engages with the locking hole 36. That is, the locking projection 5 can engage with the locking arm 16.

Figure 11:
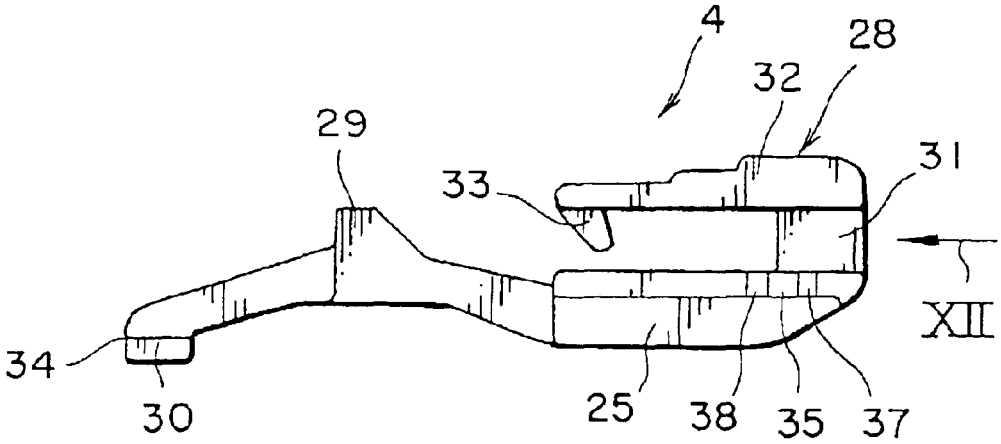
FIG. 11 is a side view illustrating a lock security member of the connector having a lock security mechanism shown in FIG. 1.
Figure 12:
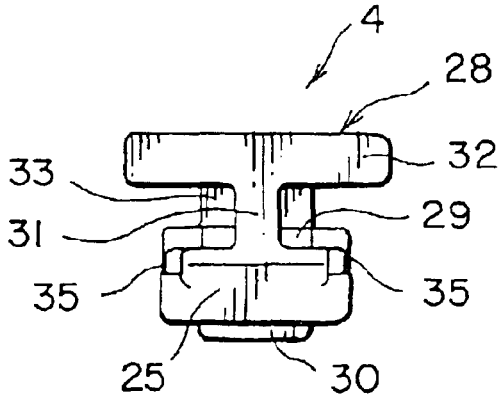
FIG. 12 is a front view illustrating the lock security member viewed from the direction of arrow XII in FIG. 11.

The lock security member 4 is made of synthetic resin and can be deformed resiliently. As shown in FIGS. 11 and 12, the lock security member 4 includes a member body 25 formed in an arm-shape, mount 28, abutting part 30, and projection 29.

The member body 25 is entered inside the locking hole 36 in a manner that the length direction of the member body 25 is parallel to the direction (arrow K shown in FIG. 1), in which the housings 2 and 3 approach each other. As shown in FIG. 14, one end of the member body 25 situated farther from the opening 18 is arranged between the body part 15 and the second bar 21*a*, which is situated farther from the opening 18 than the second bar 21*b*.

The opposite end of the member body 25 near to the opening 18 is arranged between the peripheral wall 24 and the second bar 21*b*, which is situated nearer to the opening 18 than the second bar 21*a*. That is, the member body 25 of the lock security member 4 is entered into the locking hole 36 of the locking arm 16 in a state that one end is situated between the locking arm 16 and the body part 15 while the opposite end is situated between the locking arm 16 and the peripheral wall 24.

The mount 28 continues to the one end of the member body 25. The mount 28 includes a first extending part 31, second extending part 32 and locking claw 33. The first extending part 31 extends as long as the thickness of the second bar 21*a* from the one end of the member body 25 toward the outside of the male housing 3. The second extending part 32 extends from the end of the first extending part 31 situated farther from the member body 25 toward the opening 18 in parallel with the member body 25. The second extending part 32 is longer than the width of the second bar 21*a*. The locking claw 33 extends from the end of the second extending part 32 near to the opening 18 toward the member body 25.

The mount 28 is mounted to the locking arm 16 in a state that the locking claw 33 enters into the inside of the locking hole 36 and the second bar 21*a* is received among the first extending part 31, second extending part 32 and the locking claw 33. Therefore, the mount 28, that is, the lock security member 4 is supported by the locking arm 16 moving slidably in the range between a position (hereinafter, regulated position; shown in FIG. 14) where the first extending part 31 comes in contact with the second bar 21*a* and another position (hereinafter, allowed position; shown in FIG. 16) where the locking claw 33 comes in contact with the second bar 21*a*. When the mount 28 is mounted to the locking arm 16, the second extending part 32 is exposed outside through the hole 19.

At the regulated position, the locking claw 33 is situated having a distance relatively to the second bar 21*a*. At the allowed position, the first extending part 31 is situated having a distance relatively to the second bar 21*a*. At the regulated position, the mount 28 is situated on the same plane as the outer surface 3*a* (shown in FIG. 14) of the male housing 3, which is situated farthest from the female housing 2, or a little sinks from the outer surface 3*a*. At the allowed position, the mount 28 protrudes from the outer surface 3*a* (shown in FIG. 16) of the male housing 3, which is situated farthest from the female housing 2.

The abutting part 30 is provided at the opposite end of the member body 25 near to the opening 18. The abutting part 30 extends from the opposite end toward the body part 15. At the regulated position, the abutting part 30 has a distance from the second bar 21*b*. At the allowed position, the abutting part 30 comes in contact with the second bar 21*b*. By the mount 28 and abutting part 30, the lock security member 4 slidably supported by the locking arm 16 does not come off from the locking arm 16. That is, the lock security member 4 is prevented from approaching the female housing 2 from the regulated position and also prevented from leaving the female housing 2 from the allowed position.

A surface (hereinafter, contact surface) 34 of the abutting part 30 near to the opening 18 is flat. The contact surface 34 crosses at right angles to the direction, in which the housings 2 and 3 approach each other. The contact surface 34 comes in contact with the locking projection 5 of the female housing 2 in the range between the regulated and allowed positions when the housings 2 and 3 are coupled with each other.

The projection 29 is formed at the center of the length direction of the member body 25. The projection 29 extends toward the one peripheral wall 24 from the member body 25. At the regulated position, the projection 29 comes in contact with the inner surface of the one peripheral wall 24 or faces the inner surface. At the allowed position, the projection 29 is exposed outside through the hole 19.

The width of the one end of the member body 25 is about the same as the distance between the two claws 26. A pair of projections 35 is formed at the one end of the member body 25. As shown in FIG. 12, each projection 35 protrudes from the corresponding edge of the width direction of the member body 25 toward the outside of the member body 25 in the width direction. As shown by alternate long and two short dashed line in FIGS. 20 and 21, the projection 35 includes a first inclined surface 37 and second inclined surface 38.

Figure 21:
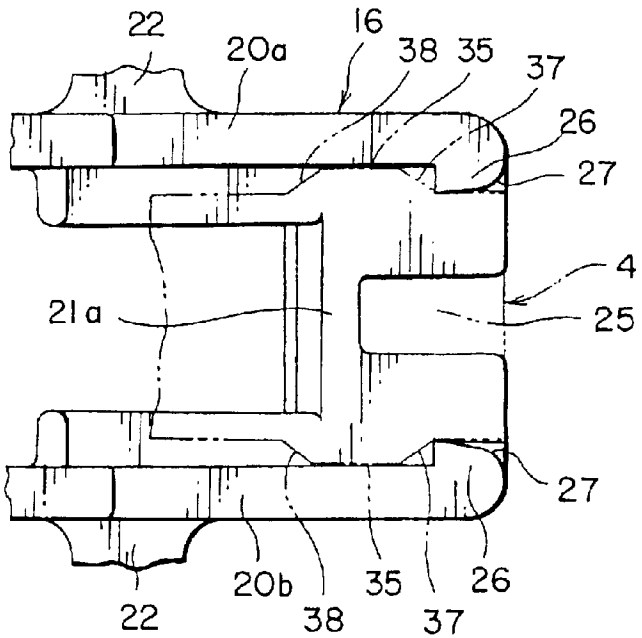
FIG. 21 is a view schematically illustrating a positional relation between a claw at the regulated position and a projection of the connector having a lock security mechanism shown in FIG. 1.

The first inclined surface 37 is formed at an end of the projection 35 apart from the opening 18, that is, near to the outside of the male housing 3. The first inclined surface 37 is inclined in the direction of approaching the member body 25 as leaving the opening 18, that is, as going to the outside of the male housing 3, and also inclined relatively to both of the length and width directions of the member body 25. As shown in FIG. 21, the first inclined surface 37 faces the claw 26 at the regulated position.

Figure 20:
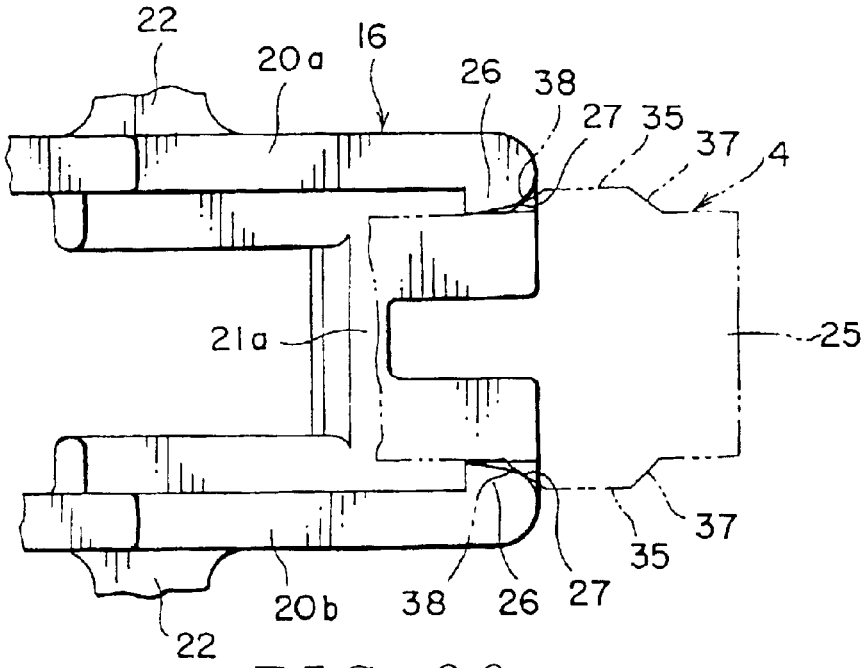
FIG. 20 is a view schematically illustrating a positional relation between a claw at the allowed position and a projection of the connector having a lock security mechanism shown in FIG. 1.

The second inclined surface 38 is formed at an end of the projection 35 near to the opening 18, that is, near to the inside of the male housing 3. The second inclined surface 38 is inclined in the direction of approaching the member body 25 as approaching the opening 18, that is, as going to the inside of the male housing 3, and also inclined relatively to both of the length and width directions of the member body 25. As shown in FIG. 20, the second inclined surface 38 faces the inclined surface 27 of the claw 26 at the allowed position. The pair of claws 26 and the pair of projections 35 constitute means for maintaining position.

As shown in FIG. 21, at the regulated position, the first inclined surface 37 faces the claw 26 and the projection 35 is situated between the first bars 20*a* and 20*b*, that is, situated inside the locking arm 16. When the lock security member 4 is displaced toward the outside of the male housing 3, the first inclined surface 37 comes in contact with the claw 26. Then, the locking arm 16 is resiliently deformed in the direction, in which the distance between the first bars 20*a* and 20*b* increases. Then, the resilient restoring force arises. Then, the claw 26 climbs over the projection 35 and as shown in FIG. 20 the second inclined surface 38 is displaced to the allowed position where the second inclined surface 38 faces the inclined surface 27 of the claw 26. Then, the resilient restoring force disappears.

When the lock security member 4 is displaced from the allowed position to the regulated position, the locking arm 16 once resiliently be deformed in the direction, in which the distance between the first bars 20*a* and 20*b* increases. Then, the resilient restoring force arises. When the lock security member 4 is displaced to the regulated position, the resilient restoring force disappears. Thus, when the lock security member 4 is displaced from the regulated position to the allowed position or displaced from the allowed position to the regulated position, the locking arm 16 is resiliently deformed and the resilient restoring force arises. Therefore, when the lock security member 4 is displaced from the regulated position to the allowed position or displaced from the allowed position to the regulated position, the resistance arises accompanied with the resilient restoring force.

Consequently, the claw 26 and projection 35 gives the control to the lock security member 4, which is displaced from the regulated position to the allowed position or displaced from the allowed position to the regulated position. Further, the claw 26 and projection 35 holds the lock security member 4 situated at the regulated position at the regulated position, and holds the lock security member 4 situated at the allowed position at the allowed position. Furthermore, the claw 26 and projection 35 lock each other by the inclined surfaces 37, 38 and so on in the range between the regulated and allowed positions.

At the regulated position, the projection 29 comes in contact with or faces the inner surface of the one peripheral wall 24. Thereby, the opposite end of the member body 25 near to the opening 18 is prevented from being displaced toward the outside of the male housing 3. That is, the locking arm 16 is prevented from being resiliently deformed. Thus, at the regulated position, the lock security member 4 regulates the resilient deformation of the locking arm 16.

At the allowed position, the projection 29 is exposed outside of the male housing 3 through the hole 19. Therefore, the end of the member body 25 near to the opening 18 is allowed to be displaced toward the outside of the male housing 3. That is, the locking arm 16 is allowed to be resiliently deformed. Thus, at the allowed position, the lock security member 4 allows the locking arm 16 to be resiliently deformed.

When the connector 1 having the lock security mechanism described above is assembled, the lock security member 4 is preferably to be situated at the regulated position as shown in FIG. 14 before the coupling of the female housing 2 and male housing 3. When the female housing 2 and male housing 3 are coupled to each other, as shown in FIGS. 1 and 14, the opening 39 of the female housing 2 (or the bushing 11) is made face the opening 18 of the male housing 3 (or the bushing 23). At this time, the opening 39 of the female housing 2 faces the body part 15.

Figure 15:
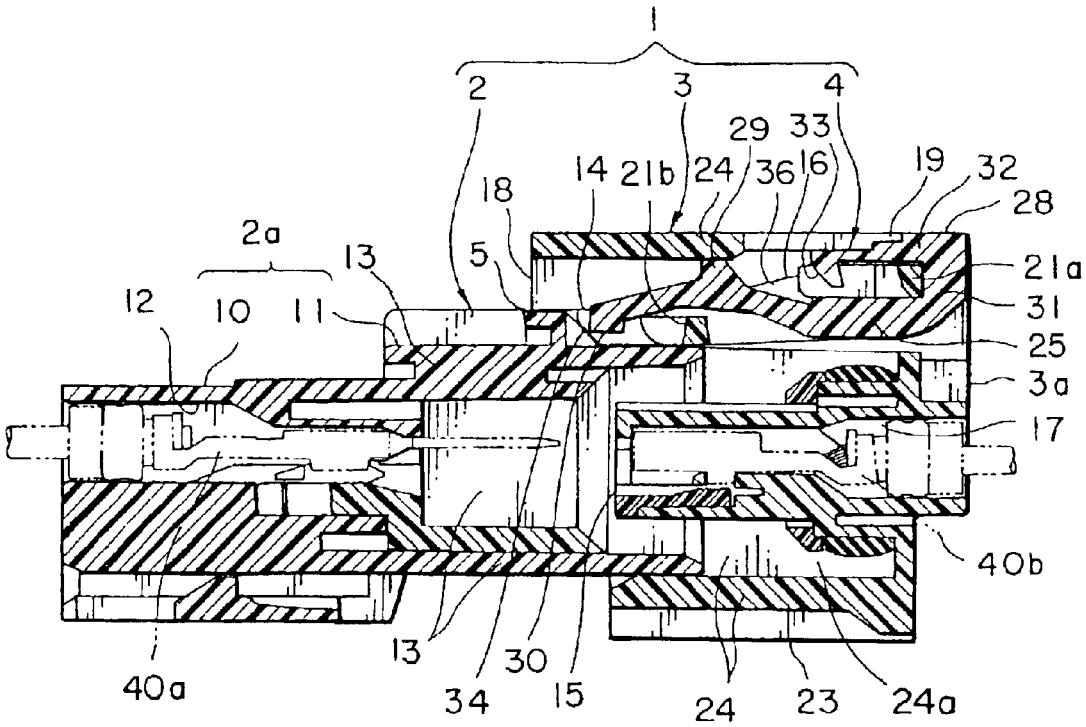
FIG. 15 is a cross sectional view illustrating a state, in which the female and male housings shown in FIG. 1 are started to be fit to each other.

Then, the body part 15 is gradually inserted into the bushing 11 and the female housing 2 is gradually inserted into the bushing 23. Thus, the female housing 2 is gradually inserted into the male housing 3. Then, as shown in FIG. 15, the tapered surface 14 of the locking projection 5 abuts against the contact surface 34, that is, against the abutting part 30 of the lock security member 4.

Figure 16:
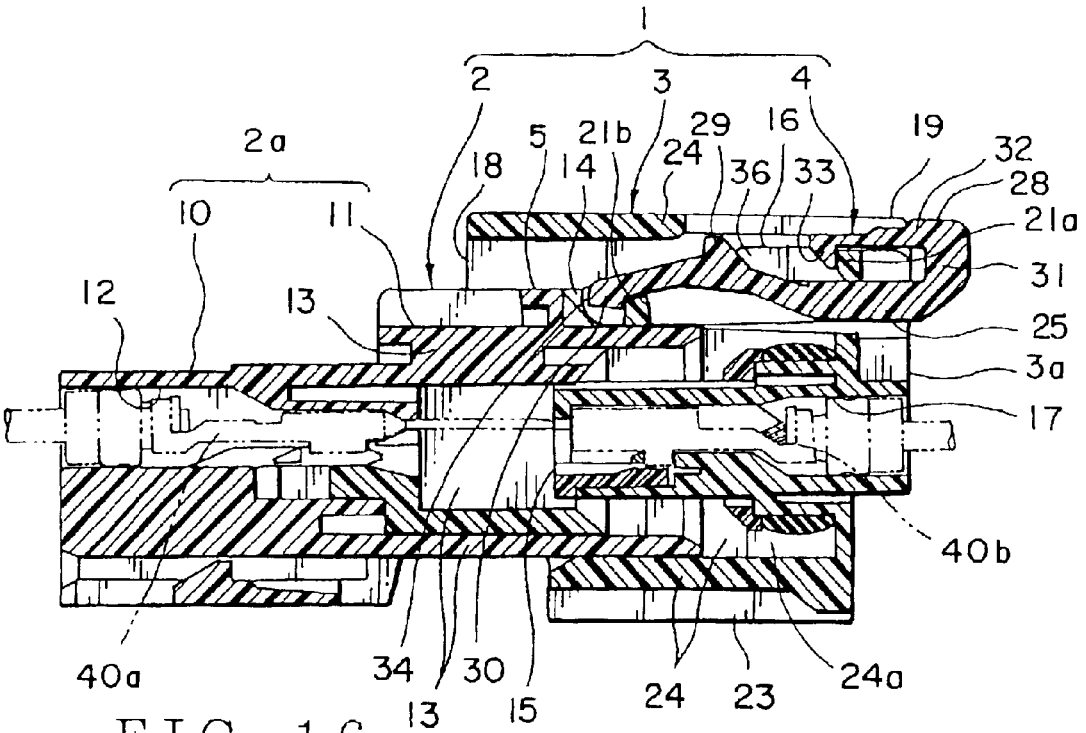
FIG. 16 is a cross sectional view illustrating a state, in which the lock security member is displaced from the state shown in FIG. 15 to an allowed position.

When the body part 15 is further inserted into the bushing 11 and the female housing 2 is further inserted into the bushing 23, the lock security member 4 slides toward the allowed position since the projection 29 faces the inner surface of the peripheral wall 24. Then, the locking arm 16 is once resiliently deformed in the direction, in which the distance between the first bars 20*a* and 20*b* increases, and the claw 26 climbs over the projection 35 and then, as shown in FIG. 16, the lock security member 4 is displaced to the allowed position. Then, the projection 29 is exposed outside through the hole 19. The locking arm 16 becomes resiliently deformable.

Figure 17:
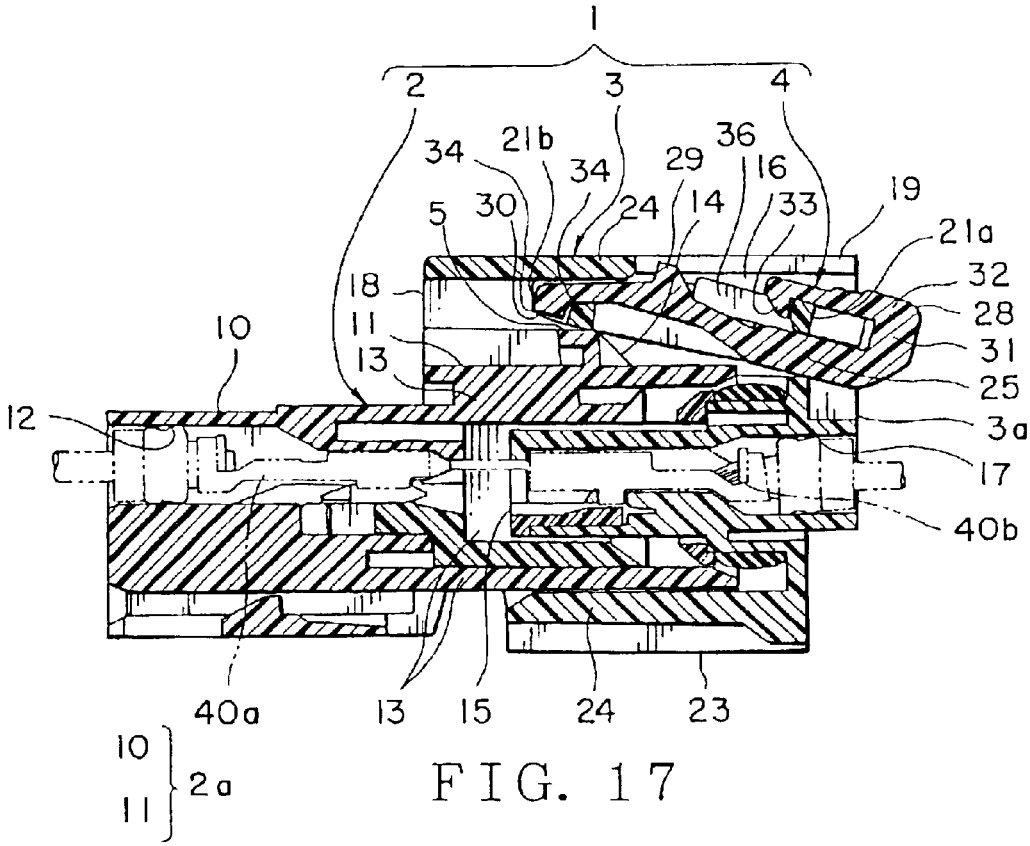
FIG. 17 is a cross sectional view illustrating a state, in which the lock security member and locking arm are resiliently deformed from the state shown in FIG. 16.

When the body part 15 is furthermore inserted into the bushing 11 and the female housing 2 is furthermore inserted into the bushing 23, the abutting part 30 and the second bar 21*b* near to the opening 18 are guided by the tapered surface 14 so as to be displaced to the outside of the male housing 3. At this time, as for the member body 25 of the lock security member 4 and the locking arm 16, the abutting part 30, that is, the opposite end of the member body 25 near to the opening 18 and the second bar 21*b* are resiliently deformed in the direction of approaching the peripheral wall 24. Then, as shown in FIG. 17, the abutting part 30 and the second bar 21*b* climb on the locking projection 5.

Thus, when the female housing 2 is coupled with the male housing 3, the lock security member 4 shifts in the direction of leaving the female housing 2 from the regulated position toward the allowed position until the locking arm 16 engages with the locking projection 5. Further, upon the coupling of the female housing 2 and male housing 3, when the lock security member 4 is situated at the allowed position, the mount 28 protrudes from the outer surface 3*a* of the male housing 3.

When the body part 15 is furthermore inserted into the bushing 11 and the female housing 2 is furthermore inserted into the bushing 23, the abutting part 30 and the second bar 21*b* climbs over the locking projection 5 and the locking projection 5 enters into the locking hole 36. When the locking projection 5 enters into the locking hole 36, as shown in FIG. 18, the locking projection 5 engages with the locking hole 36 by the resilient restoring force of the locking arm 16 and the member body 25.

Figure 24:
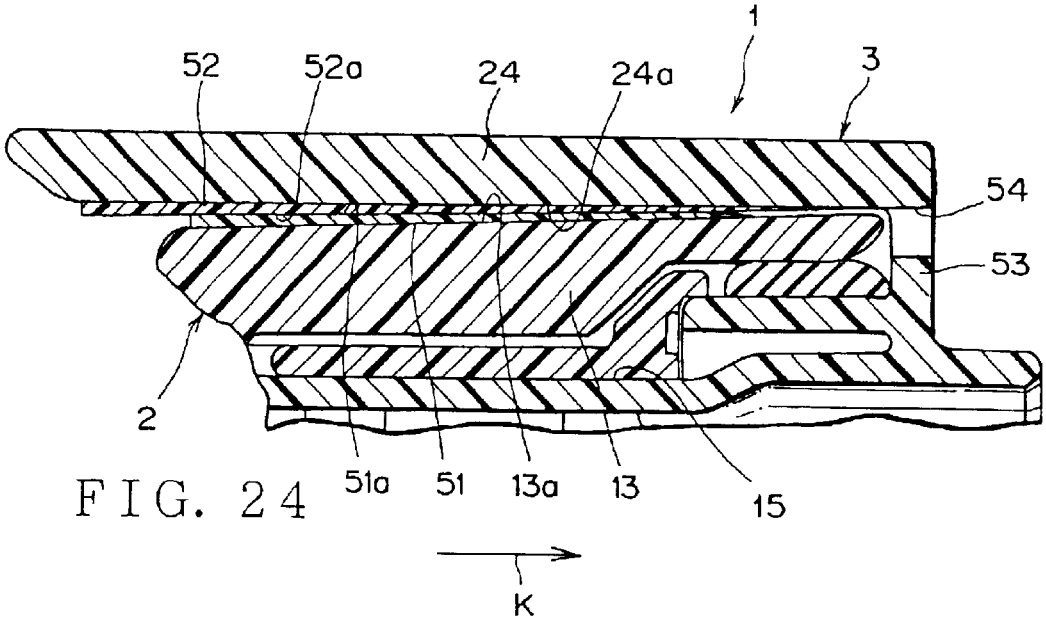
FIG. 24 is a cross sectional view illustrating a primary state when the male housing shown in FIG. 5 is coupled with the female housing shown in FIG. 10.

Thus, when the female housing 2 is coupled with the male housing 3 in a state that the lock security member 4 is situated at the regulated position, the lock security member 4 is displaced to the allowed position. Thereafter, the lock security member 4 is shifted toward the female housing 2. Then, the locking arm 16 is once resiliently deformed in the direction, in which the distance between the first bars 20*a* and 20*b* increases. Then, as shown in FIG. 19, the lock security member 4 is situated at the regulated position. The female housing 2 is coupled with the male housing 3, thereby the male terminal 40*a* is electrically connected to the female terminal 40*b*. When the female housing 2 is coupled with the male housing 3, as shown in FIG. 24, the surface 51*a* of the first rib 51 closely comes in contact with the surface 52*a* of the second rib 52. Thus, the first rib 51 comes in contact with the second rib 52.

When the coupled female housing 2 and male housing 3 is to be decoupled, first the lock security member 4 is shifted from the regulated position toward the allowed position. Thereafter, the mount 28 is pushed downward in FIG. 18 so as to resiliently deform the locking arm 16 and the lock security member 4, thereby the second bar 21*b* and the abutting part 30 are parted away from the peripheral wall 13 of the female housing 2. Then, the locking projection 5 comes out from the locking hole 36. Then, the female housing 2 is shifted in the direction of leaving the male housing 3, thereby the coupled female housing 2 and male housing 3 is decoupled.

When the female housing 2 is half coupled (i.e., incompletely coupled) with the male housing 3, that is, as shown in FIG. 17, when the abutting part 30 and the second bar 21*b* climb on the locking projection 5 and the locking projection 5 does not engage with the locking hole 36, the lock security member 4 can not shift toward the regulated position since the projection 29 comes in contact with the edge of the hole 19, for example. Thus, by checking whether or not the lock security member 4 can shift toward the regulated position, it can be known whether or not the housings 2 and 3 are securely coupled with each other.

In a state that the housings 2 and 3 are coupled with each other, the projection 29 of the lock security member 4 faces or comes in contact with the inner surface of the peripheral wall 24 of the male housing 3. The projection 29 regulates the deformation of the member body 25 and the locking arm 16 in the direction, in which the engagement between the locking projection 5 and the locking arm 16 is removed. Therefore, in the state that the lock security member 4 is situated at the regulated position and the housings 2 and 3 are coupled with each other, when the coupling between the housings 2 and 3 is tried to be removed, the locking projection 5 keeps engaging with the locking hole 36. Therefore, once the lock security member 4 is situated at the regulated position, the coupled housings 2 and 3 is never accidentally decoupled.

Further, when the lock security member 4 situated at the regulated position is made shift in the direction of leaving the female housing 2 in a state that the housings 2 and 3 are coupled with each other, the projection 29 does not obstruct the movement of the lock security member 4. Therefore, the lock security member 4 can be smoothly shifted to the allowed position. By shifting the lock security member 4 from the regulated position to the allowed position, the coupled housings 2 and 3 can be easily decoupled.

In this preferred embodiment, the female housing 2 has the first rib 51 protruding from the outer surface 13*a* of the female housing 2 while the male housing 3 has the second rib 52 protruding from the inner surface 24*a* of the male housing 3. When the female housing 2 is coupled with the male housing 3, the surface 51*a* of the first rib 51 comes in contact with the surface 52*a* of the second rib 52. The protrusion length of the first rib 51 from the outer surface 13*a* of the female housing 2 gradually increases as leaving the opening 39. The protrusion length of the second rib 52 from the inner surface 24*a* of the male housing 3 gradually decreases as leaving the opening 18.

Figure 22:
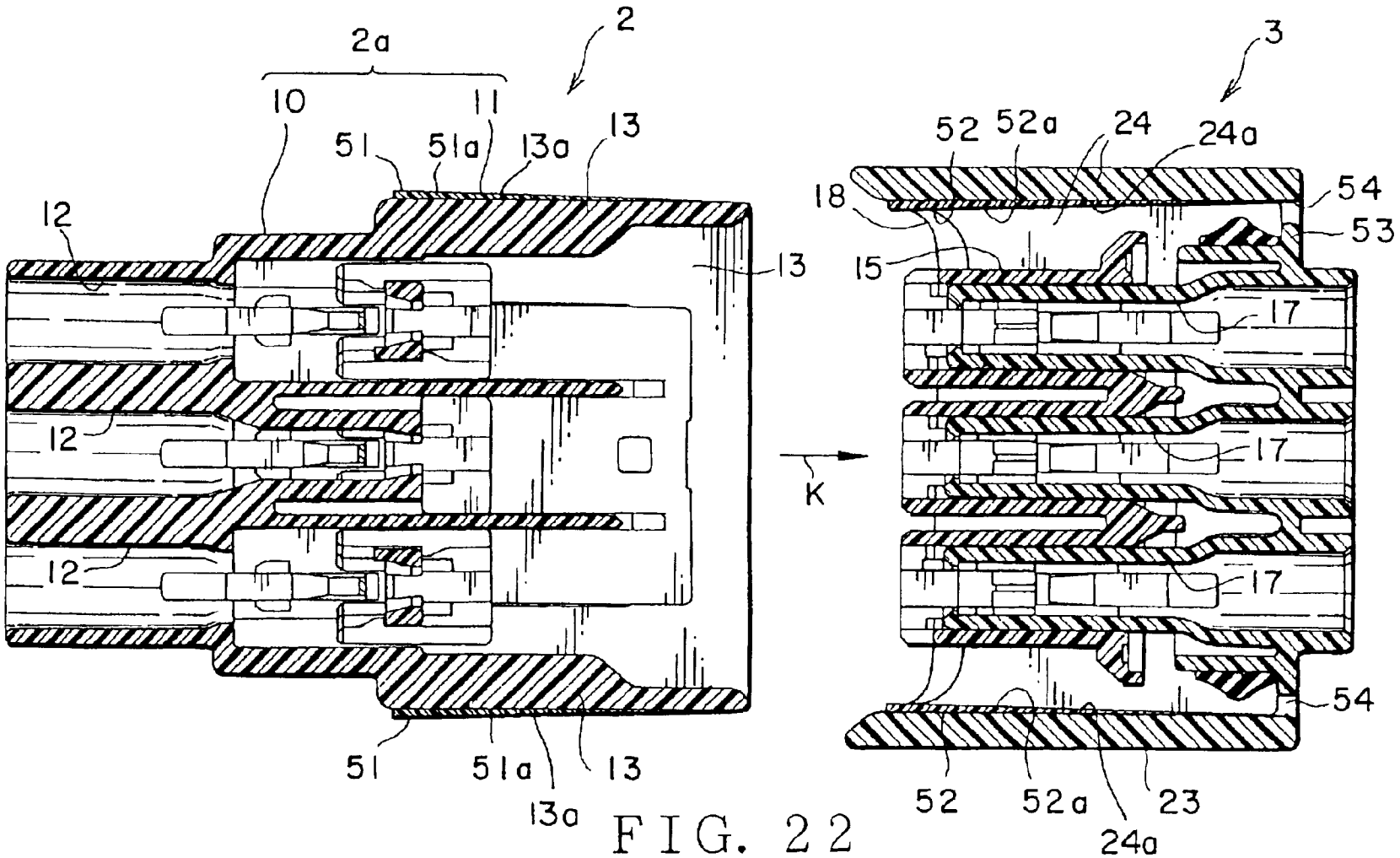
FIG. 22 is a cross sectional view illustrating the male housing shown in FIG. 5 and the female housing shown in FIG. 10.

Therefore, even if the housing 2, 3 is deformed in the direction, in which the opening 39, 18 extends, as shown in FIG. 22, the surface 51*a* of the first rib 51 and the surface 52*a* of the second rib 52 is flat along the direction K (shown by an arrow in FIG. 22), in which the female housing 2 is inserted into the male housing 3. Therefore, when the female housing 2 is coupled with the male housing 3, the surface 51*a* of the first rib 51 closely comes in contact with the surface 52*a* of the second rib 52. Therefore, backlash hardly arises between the female housing 2 and the male housing 3. Therefore, the male terminal 40*a* received in the female housing 2 and the female terminal 40*b* received in the male housing 3 can be securely electrically connected.

Figure 23:
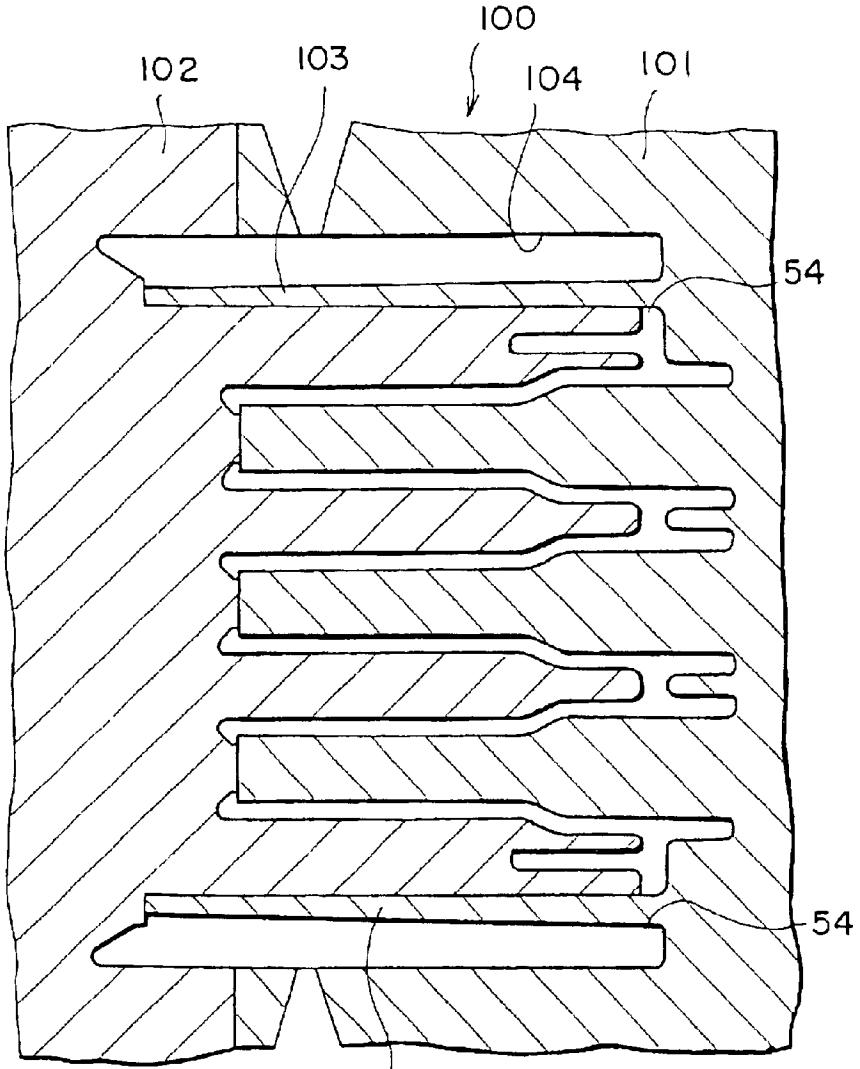
FIG. 23 is a cross sectional view illustrating an example of a mold used for molding the male housing shown in FIG. 5.

The hole 54 penetrating through the wall 53 is opened at the end of the second rib 52. Thus, the hole 54 is provided at the end of the second rib 52. Therefore, as shown in FIG. 23, when the male housing 3 is molded, a part 103 of a mold 100 for molding the second rib 52 can be slid through the hole 54. Thus, since the hole 54 is provided, the male housing 3 can be easily molded.

The mold 100 shown in FIG. 23 is used when the male housing 3 is molded. The mold 100 includes a first mold 101 and second mold 102, between which a cavity 104 is formed imitating the outer shape of the male housing 3. The part 103 for molding the second rib 52 is provided to the first mold 101.

When the female housing 2 is about to be coupled with the male housing 3, the lock security member 4 is displaced from the regulated position to the allowed position. Therefore, a worker can easily recognize the lock security member 4. That is, a worker does not forget to displace the lock security member 4 toward the regulated position. Therefore, after the coupling of the housings, an accidental decoupling between the female housing 2 and male housing 3 can be securely prevented from occurring.

Further, by checking the position of the lock security member 4, it can be securely known whether or not the locking arm 16 engages with the locking projection 5. Therefore, after the coupling of the housings, an accidental decoupling between the female housing 2 and male housing 3 can be securely prevented from occurring.

Further, when the female housing 2 is about to be coupled with the male housing 3, the mount 28 of the lock security member 4 protrudes from the outer surface 3*a* of the male housing 3 toward the outside. Therefore, a worker can easily recognize the lock security member 4. That is, a worker does not forget to displace the lock security member 4 toward the regulated position. Therefore, after the coupling of the housings, an accidental decoupling between the female housing 2 and male housing 3 can be securely prevented from occurring.

At the allowed position, the mount 28 of the lock security member 4 protrudes. Therefore, the locking arm 16 can be easily deformed resiliently through the lock security member 4 and the engagement between the locking arm 16 and the locking projection 5 can be easily removed. That is, the coupling between the female housing 2 and the male housing 3 can be easily removed.

The pair of claws 26 and pair of projections 35 maintain the position of the lock security member 4. Therefore, after the coupling between the female housing 2 and the male housing 3, the lock security member 4 displaced to the regulated position can be prevented from being displaced to the allowed position. Therefore, after the coupling of the housings, an accidental decoupling between the female housing 2 and male housing 3 can be securely prevented from occurring.

At the regulated position, the projection 29 comes in contact with the inner surface of the peripheral wall 24 of the male housing 3, thereby preventing the member body 25 of the lock security member 4 and the locking arm 16 from being resiliently deformed. That is, at the regulated position, the projection 29 regulates the resilient deformation of the locking arm 16. Thus, when the lock security member 4 is situated at the regulated position, the resilient deformation of the locking arm 16 is regulated, thereby preventing an accidental decoupling of the housings 2 and 3.

In a state that the locking arm 16 is resiliently deformed, the projection 29 tends to protrude from the hole 19. Therefore, in a state that the locking arm 16 is resiliently deformed, the projection 29 keeps the lock security member 4 at the allowed position. Thus, a worker can easily know whether or not the locking arm 16 completely engages with the locking projection 5, that is, whether or not the female housing 2 is completely coupled with the male housing 3.

In the preferred embodiments described above, the female housing 2 is provided with the locking projection 5 and the male housing 3 is provided with the lock security member 4, locking arm 16 and the locking hole 36. Instead, the male housing 3 may be provided with the locking projection 5 and the female housing 2 may be provided with the lock security member 4, locking arm 16 and the locking hole 36.

In the aforementioned preferred embodiment, there are provided the first rib 51 protruding from the outer surface 13*a* of the female housing 2 and the second rib 52 protruding from the inner surface 24*a* of the male housing 3. Instead, as shown in FIGS. 25 and 26, only one rib of the first and second ribs may be provided.

Figure 25:
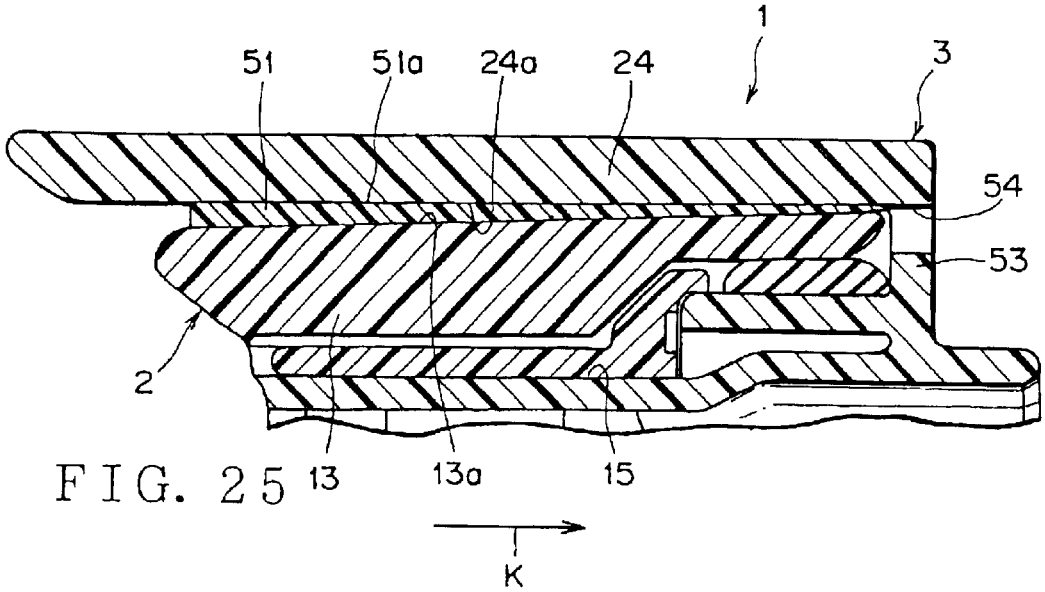
FIG. 25 is a cross sectional view illustrating a primary state when the male and female housings are coupled with each other according to a modified example of the present invention.

In an example shown in FIG. 25, only the first rib 51 is provided without the second rib 52. When the female housing 2 is coupled with the male housing 3, the surface 51*a* of the first rib 51 comes in contact with the inner surface 24*a* of the male housing 3. In this case, even when the housing 2, 3 is deformed in the direction, in which the opening 39, 18 extends, the surface 51*a* of the first rib 51 is parallel with arrow K.

Therefore, when the female housing 2 is coupled with the male housing 3, the surface 51*a* of the first rib 51 closely comes in contact with the inner surface 24*a* of the male housing 3. Thus, the first rib 51 comes in contact with the inner surface 24*a* of the male housing 3., Therefore, after the coupling of the housings 2 and 3, the backlash between the housings 2 and 3 hardly arises. That is, the male terminal 40*a* received in the female housing 2 can be securely connected electrically to the female terminal 40*b* received in the male terminal 3.

Figure 26:
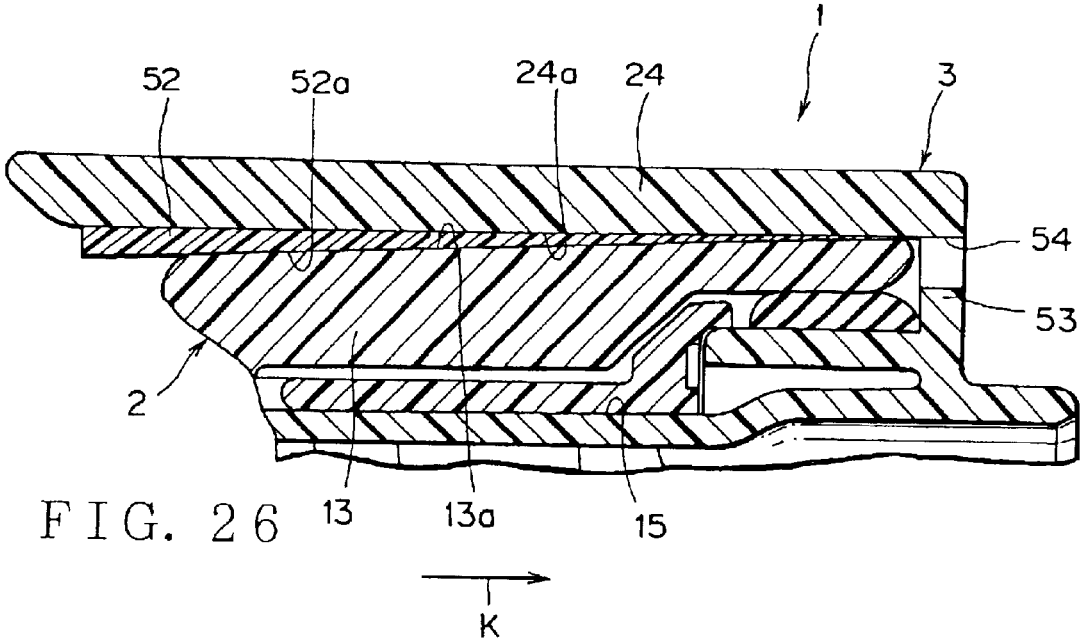
FIG. 26 is a cross sectional view illustrating a primary state when the male and female housings are coupled with each other according to another modified example of the present invention.

In an example shown in FIG. 26, only the second rib 52 is provided without the first rib 51. When the female housing 2 is coupled with the male housing 3, the surface 52*a* of the second rib 52 comes in contact with the outer surface 13*a* of the female housing 2. In this case, even when the housing 2, 3 is deformed in the direction, in which the opening 39, 18 extends, the surface 52*a* of the second rib 52 is parallel with arrow K.

Therefore, when the female housing 2 is coupled with the male housing 3, the surface 52*a* of the second rib 52 closely comes in contact with the outer surface 13*a* of the female housing 2. Thus, the second rib 52 comes in contact with the outer surface 13*a* of the female housing 2. Therefore, after the coupling of the housings 2 and 3, the backlash between the housings 2 and 3 hardly arises. That is, the male terminal 40*a* received in the female housing 2 can be securely connected electrically to the female terminal 40*b* received in the male terminal 3.

The aforementioned preferred embodiments are described to aid in understanding the present invention and variations may be made by one skilled in the art without departing from the spirit and scope of the present invention.

What is claimed is:

1. A mating pair of connectors comprising a first connector and a second connector, each of the connectors being generally tube-shaped and comprising generally tubular respective surfaces facing one another when the connectors are mated by inserting the connectors one into another;

wherein the first connector comprises a first rib rising above the generally tubular surface of the first connector;

the first rib making contact with the generally tubular opposite surface of the second connector, when the connectors are mated;

a first end of the first rib being adjacent to an edge of an open end of the first connector;

the first rib extending in a mating direction of the pair of connectors; and the first rib having a first height above the surface of the first connector that gradually increases with distance away from the edge of the open end of the first connector.

2. The connectors according to claim 1, wherein the first height increases in proportion to the distance, whereby the first rib comprises a ramp.

3. The connectors according to claim 1, comprising a second rib rising above the generally tubular surface of the second connector;

the second rib making contact with the generally tubular surface of the first connector, when the connectors are mated;

a first end of the second rib being near to an edge of an open end of the second connector;

the second rib extending in the mating direction of the pair of connectors; and wherein the first rib and the second rib are in contact when the connectors are mated.

4. The connectors according to claim 3, wherein the second rib has a second height above the surface of the second connector that gradually changes with distance away from the edge of the open end of the second connector.

5. The connectors according to claim 4, wherein the second height above the surface of the second connector gradually decreases with the distance.

6. The connectors according to claim 5, wherein the second height decreases in proportion to the distance, whereby the second rib comprises a ramp.

7. The connectors according to claim 4, wherein the second height gradually increases over a full length of the second rib.

8. The connectors according to claim 4, wherein the second height gradually increases over substantially a full length of the surfaces facing one another when the connectors are mated.

9. The connectors according to claim 1, wherein the first height gradually increases over a full length of the first rib.

10. The connectors according to claim 1, wherein the first height gradually increases over substantially a full length of the surfaces facing one another when the connectors are mated.

11. A mating pair of connectors comprising a first connector and a second connector, each of the connectors being generally tube-shaped and comprising generally tubular respective surfaces facing one another when the connectors are mated by inserting the connectors one into another;

wherein the first connector comprises a first rib rising above the generally tubular surface of the first connector;

the first rib making contact with the generally tubular opposite surface of the second connector, when the connectors are mated;

a first end of the first rib being near to an edge of an open end of the first connector;

the first rib extending in a mating direction of the pair of connectors; and the first rib having a first height above the surface of the first connector that gradually increases with distance away from the edge of the open end of the first connector;

comprising a second rib rising above the generally tubular surface of the second connector;

the second rib making contact with the generally tubular surface of the first connector, when the connectors are mated;

a first end of the second rib being near to an edge of an open end of the second connector;

the second rib extending in the mating direction of the pair of connectors; and wherein the first rib and the second rib are in contact when the connectors are mated;

wherein the second connector is a female connector and comprises a wall closing an end opposite to the edge of the open end of the second connector, along the generally tubular surface of the second connector, wherein the wall comprises a hole, and wherein the hole is located adjacent to a second end of the second rib distal the first end of the second rib.

* * * * *